United States Patent [19]

Laufer

[11] 4,302,760

[45] Nov. 24, 1981

[54] WIDEBAND VERTICAL DOUBLET ANTENNA

[75] Inventor: Shlomo Laufer, Kiryat Ono, Israel

[73] Assignee: Tadiran Israel Electronics Industries Ltd., Tel Aviv, Israel

[21] Appl. No.: 150,134

[22] Filed: May 15, 1980

[30] Foreign Application Priority Data

May 16, 1979 [IL] Israel ..... 57312

[51] Int. Cl.[3] ..... H01Q 1/32

[52] U.S. Cl. ..... 343/715; 343/792; 343/893

[58] Field of Search ..... 343/792, 853, 893, 715, 343/900

[56] References Cited

U.S. PATENT DOCUMENTS

| | | | |
|---|---|---|---|
| 3,550,145 | 12/1970 | Tai | 343/893 |
| 3,932,873 | 1/1976 | Garcia | 343/792 |
| 3,961,331 | 6/1976 | Campbell | 343/792 |
| 4,217,589 | 8/1980 | Stahler | 343/792 |

*Primary Examiner*—Eli Lieberman

*Attorney, Agent, or Firm*—Fleit & Jacobson

[57] ABSTRACT

The present invention relates to a wideband VHF antenna of omnidirectional directivity, comprising a substantially vertical elongated structure consisting of an upper part consisting of a plurality of wires of different length, electrically insulated from each other, of a length of about one-fourth of the longest wave-length to about one-fourth of the shortest wave-length of the waveband, arranged with their contiguous parts parallel with each other and close to each other, and a lower part in the form of a coaxial structure, the lower ends of the said wires being connected with the inner wire of the said coaxial structure, said inner wire constituting an impedance multi-step transformer of at least two stages, said inner wire constituting the winding of at least one ferrite torroid forming an effective ground isolation, the outer conducting sheath of the coaxial structure constituting the lower part of the dipole, the impedance of the antenna being matched to that of the receiver and/or transmitter with which it is to be used. A preferred embodiment relates to an antenna for use in the 30 to 88 MHz waveband from 3 to 12 wires in the upper part, of a length from 85 to 182 cm.

10 Claims, 5 Drawing Figures

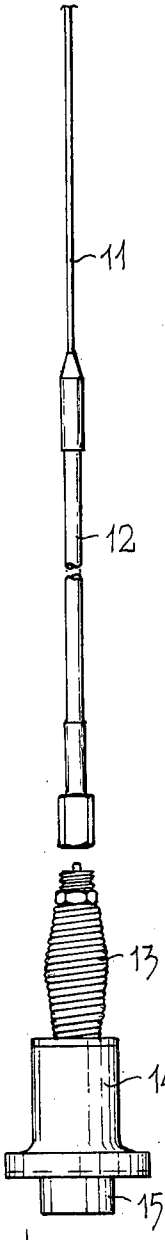
FIG. 1
FIG. 2
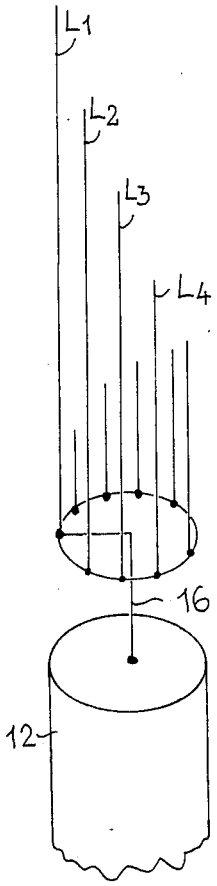
FIG. 3
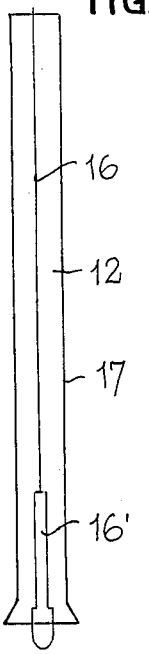
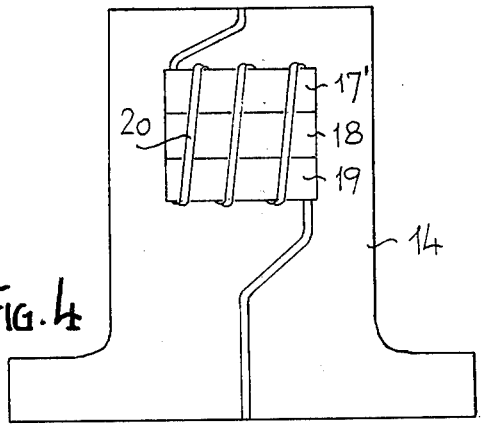
FIG. 4
FIG. 5
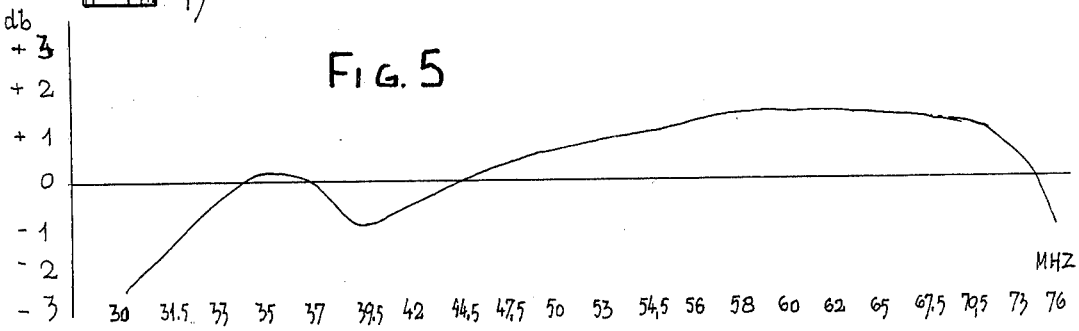

WIDEBAND VERTICAL DOUBLET ANTENNA

FIELD OF THE INVENTION

The present invention relates to a novel wideband antenna for use through about 30 to 88 MHz, which substantially maintains its characteristics throughout this range and which does not require antenna matching circuits. The novel antenna can be used with wideband transmitters, receivers and transceivers of this frequency band. The novel antenna is of special use with both stationary and mobile equipment, and especially with military communication equipment mounted on suitable vehicles.

BACKGROUND OF THE INVENTION

Various types of antennas are used in the frequency band of about 30 to 88 MHz. The most widely used tactical vehicular antenna is the one known under the designation AS-1729 which operates over the frequency range of 30 to 76 MHz. This antenna possesses satisfactory electrical characteristics, but matching of impedance is required and this is effected by a 10-section matching network, the impedance of which is changed by a motor driven selector switch. The motor is comparatively slow and cumbersome and this prevents rapid repeated switchovers of the frequencies used.

The novel antenna according to the present invention is of comparatively simple construction, it eliminates the necessity of mechanical changeover and thus rapid switches of frequencies used become feasible, overcoming the drawbacks of the previous antennas.

SUMMARY OF THE INVENTION

The present invention relates to a novel wideband VHF antenna, which can be used in a waveband such as 30 to 88 MHz, or at any other desired frequency range, and which comprises a single wideband matching network. This requires no switching. According to a preferred embodiment of the invention "ground isolation" properties are provided, and this facilitates the mounting of the novel antenna on any desired type of vehicle. Due to this ground isolation the characteristics of the antenna do not depend on, or change with the type of vehicle on which same is mounted.

The motor switch and control cable of conventional antennas are eliminated, and this results in a more economical product, which at the same time has considerable operational advantages over the conventional type of antenna used to cover such wavebands.

The novel antenna of the present invention is an elongated structure, adapted to be mounted substantially vertically, which structure comprises an upper part consisting of a unit of multi-element radiating dipoles, parallel and close to each other, which are a series of wires of different lengths, from about $\frac{1}{4}$ wave-length of the highest frequency to about $\frac{1}{4}$ wave-length of the lowest frequency, and a lower part in the form of a coaxial structure, the upper part being electrically connected to the inner wire of the coaxial structure, said inner wire defining a coaxial impedance multi-step transformer, which is used as winding of at least one torroid, adapted to be connected with the receiver and/or transmitter, the outer conductor of the coaxial structure constituting the lower part of the dipole, the impedance being matched to that of the receiver and/or transmitter, said torroid constituting an effective ground isolation.

According to a preferred embodiment the upper part comprises from about 6 to 12 parallel wires of different length, the preferred number being from about 8 to 10. Advantageously a sequence of length of wires from about 85 to about 182 cm is used, and the increments between the length can be a gradual one or it can be according to any suitable ratio. The multi-step transformer has two or more stages, the preferred number being from 2 to 4. Although one torroid gives satisfactory results, it is preferred to use 2 to 4 torroids. The antenna is matched in its impedance to that of the receiver and/or transmitter or transceiver, and the type of equipment most frequently used requires a matching of 50 to 75 ohms.

In order to avoid undue overall length, the longest of the wires can be somewhat shorter than one-quarter the wavelength, and the other wires are of corresponding length.

The novel antenna covers about 1.5 octaves of frequencies, and has very satisfactory characteristics of performance. The use of a single impedance matching network over the entire frequency band makes it possible to use the antenna for advanced transmitting techniques, such as frequency hopping, and in this respect the novel antenna constitutes a pronounced improvement over the AS-1729 type antenna.

The novel antenna is electrically equivalent to a vertical dipole. The location near the center of the whip, where the upper part is attached to the inner conductor of the coaxial structure is referred to as the feed point. The outside surface of the coaxial structure constitutes the lower element of the dipole. The coaxial structure serves to supply RF energy to the feed point and it also serves as a coaxial transformer section.

The novel antenna is omnidirectional and its average gain is equivalent to that of the AS-1729 antenna.

DESCRIPTION OF THE PREFERRED EMBODIMENT

The novel antenna is described with reference to the enclosed schematical drawings, which are not according to scale, and in which:

FIG. 1 is a side-view of the antenna,

FIG. 2 illustrates the elements of the upper part of the antenna,

FIG. 3 illustrates the construction of the lower element of

FIG. 4 is a sectional side view of the base of the antenna,

FIG. 5 is a comparative diagram illustrating the performance of the antenna.

As shown in FIG. 1, the antenna comprises an upper part 11, and a lower part 12, which is mounted via spring member 13 with base 14, provided with an RF-connector 15. FIG. 2 illustrates the construction of the upper part of the antenna. This upper part 11 comprises a plurality of wires, $L_1$ to $L_9$ in this figure, which are of different length, and which in the actual antenna are close together, ensheathed in a fiberglass sheath, which is not shown in this figure. The length of the wires ranges from about one-fourth of the shortest wave-length and up to one-fourth of the longest wave-length. In practice, the longest wire can be somewhat shorter so as to result in a reduced overall length of the antenna.

The wires $L_1$ to $L_9$, in this specific embodiment, are insulated from each other, and electrically connected with the inner coaxial cable 16 of the lower part 12, which is a coaxial structure comprising said inner wire 16, the outer sheath 17 of the coaxial structure being a conductor which constitutes the lower part of the dipole, said inner wire 16 defining a coaxial impedance multi-step transformer of at least two stages, the lower part of the sheath 17 being attached via spring member 13 to the base structure 14 shown in FIG. 4. The inner wire 16 extends to the base member 14 wherein 3 torroids 17', 18 and 19 are provided, around which a cable 20 is wound. The function of the ferrite torroids is that of an RF cable choke, the purpose of which is to provide ground isolation by its high RF impedance over a broad frequency band between opposite ends of the braided outer conductor of the coaxial cable with which the choke is wound. This ground isolation permits the mounting of the antenna on different types of vehicles, without thereby changing the performance of the antenna.

The antenna illustrated with reference to the 9-wire arrangement of FIG. 2 is a specific example. This antenna has the following characteristics: It is a broadband dipole antenna for the frequency range of 30 to 88 MHz, with an input impedance of 50 ohm and VSWR of 3.5:1 type. The antenna comprises nine wires of different lengths, from 85 cm to 182 cm in increments as follows: 85 cm, 92 cm, 106 cm, 120 cm, 134 cm, 148 cm, 162 cm, 176 cm and 182 cm. The length of wire 16 was 795 cm, and section 16' was 203 mm. The overall length of the antenna is 3.4 m and its weight is about 3.5 kg.

The three toroids 17', 18 and 19 of the base 14 (FIG. 4) were wound with cable 20 consisting of 40 cm of a 75 ohm cable and with 90 cm of a 50 ohm cable, connected in series. The characteristics of the novel antenna, compared with those of an AS-1729 antenna are presented in FIG. 5.

It is clear that the above description is by way of illustration only and that many variations and modifications in the nature and arrangements of parts may be resorted to without departing from the scope and spirit of the invention.

The number of wires of the upper structure and the relation between the length of the individual wires can be varied. The number of steps of the impedance multi-step transformer can be varied at will, and this applies also to the number of torroids used.

The novel antenna can be used for advanced transmitting techniques, such as frequency hopping.

I claim:

1. A wideband VHF antenna of omnidirectional directivity, comprising a substantially vertical elongated structure including an upper part comprising a plurality of wires of different length, electrically insulated from each other, and of a length of about one-fourth of the longest wave-length to about one-fourth of the shortest wave-length of the waveband, said plurality of wires being arranged with their contiguous parts parallel to each other and close to each other, said vertical elongated structure also including a lower part in the form of a coaxial structure having an inner wire and an outer conducting sheath, the lower ends of the said plurality of wires being connected with the inner wire of the said coaxial structure, said inner wire comprising an impedance multi-step transformer of at least two stages, said inner wire constituting the winding of at least one ferrite toroid forming an effective ground isolation, the outer conducting sheath of the coaxial structure constituting the lower part of a dipole, the impedance of the antenna being matched to that of at least one of the receiver and transmitter with which it is to be used.

2. An antenna according to claim 1, for use in the 30 to 88 MHz waveband, comprising from 3 to 12 wires in the upper part.

3. An antenna according to claim 2, said plurality of wires of said upper part comprising 7 to 10 wires.

4. An antenna according to claim 2, said plurality of wires of said upper part comprising 9 wires.

5. An antenna according to claim 1, wherein the length of the plurality of wires of the upper part is from about 85 to 182 cm.

6. An antenna according to claim 2, wherein the length of the plurality of wires differs by indentical increments.

7. An antenna according to claim 1, wherein said multi-step transformer comprises a two-step impedance transformer.

8. An antenna according to claim 2, wherein said at least one toroid comprises from 1 to 4 toroids.

9. An antenna according to claim 1, said plurality of wires of the upper part comprising nine wires having a length of 85 cm, 92 cm, 106 cm, 120 cm, 134 cm, 148 cm, 162 cm, 176 cm and 182 cm, respectively, said lower part including a base member, the length of the lower part being about 100 cm without the base member.

10. An antenna according to claim 1, wherein said multi-step transformer comprises a three-step impedance transformer.

* * * * *